US005479769A

United States Patent [19]

Belloy et al.

[11] Patent Number: 5,479,769

[45] Date of Patent: Jan. 2, 1996

[54] METHOD AND APPARATUS FOR CONNECTING THE ENDS OF TWO ASSEMBLAGES OF THREADS

[75] Inventors: Jean Belloy, Riom; Pierre Jonville, Clermont-Ferrand, both of France; Guido Valente, Salo, Italy

[73] Assignee: Compagnie Generale des Etablissements Michelin - Michelin & Cie, Clermont Ferrand Cedex, France

[21] Appl. No.: 445,162

[22] Filed: May 19, 1995

Related U.S. Application Data

[63] Continuation of Ser. No. 94,099, Aug. 3, 1993, abandoned.

[30] Foreign Application Priority Data

Feb. 6, 1991 [FR] France ..... 91 01417

[51] Int. Cl.[6] ..... D01H 15/00

[52] U.S. Cl. ..... 57/22

[58] Field of Search ..... 57/22, 23, 1 UN, 57/202

[56] References Cited

U.S. PATENT DOCUMENTS

| | | | |
|---|---|---|---|
| 1,459,875 | 6/1923 | Brigham . | |
| 1,463,401 | 7/1923 | Pearson et al. . | |
| 3,273,330 | 9/1966 | Gonsalves . | |
| 3,306,020 | 2/1967 | Rosenstein | 57/22 |
| 3,379,002 | 4/1968 | Rosenstein | 57/22 X |
| 4,199,928 | 4/1980 | Cristaldi . | |
| 4,214,431 | 7/1980 | Bruce et al. | 57/22 |
| 4,534,160 | 8/1985 | Lorenz . | |
| 4,570,427 | 2/1986 | Premi et al. . | |
| 4,574,570 | 3/1986 | Franzen | 57/1 UN |

FOREIGN PATENT DOCUMENTS

| | | | |
|---|---|---|---|
| 1422895 | 9/1964 | France . | |
| 1582148 | 5/1968 | France . | |
| 3342874 | 11/1983 | Germany . | |
| 4002343 | 8/1990 | Germany | 57/22 |

OTHER PUBLICATIONS

Research Disclosure No. 263, Mar. 1986, p. 164.

*Primary Examiner*—Joseph J. Hail, III

*Attorney, Agent, or Firm*—Brumbaugh, Graves, Donohue & Raymond

[57] ABSTRACT

A method and device (100) for connecting the ends of two assemblages (1A, 1B) of threads (10A, 10B). The ends of the assemblages (1A, 1B) are subjected to an untwisting operation in order to separate the threads (10A1, 10B1) of these ends from each other; as many junction pairs (C) as there are threads (10A1, 10B1) are formed in each of the assemblages (1A, 1B); the filaments of the threads (10A1, 10B1) in the pairs (C) are untwisted, the untwisted parts are placed side by side in each pair (c) so as to obtain a junction region (15); the filaments of the two threads (10A1, 10B1) are assembled together by air splicing in each region (15); all the threads (10A, 10B) thus combined are assembled together by twisting. Joint assemblages thus obtained. Articles, for instance automobile tires, reinforced with these assemblages.

16 Claims, 3 Drawing Sheets

METHOD AND APPARATUS FOR CONNECTING THE ENDS OF TWO ASSEMBLAGES OF THREADS

This application is a continuation of application Ser. No. 08/094,099, filed on Aug. 3, 1993 now abandoned.

BACKGROUND OF THE INVENTION

The present invention relates to methods and devices which make it possible simultaneously to connect several pairs of ends of assemblages of textile threads, the threads of these assemblages being multifilaments.

By way of example, an assemblage of threads is referred to as a "twist" when it is formed of several threads combined by a single twisting operation.

Such assemblages are used, for instance, to reinforce plastic and/or rubber articles, such articles being, for instance, belts, hoses and tires.

The invention, in particular, relates to methods and devices which make it possible to connect two twists by joining the two pairs of ends of threads of these twists.

The conventional methods of joining textile assemblages are essentially of two types:

The first type consists of mechanical joinings using various methods, such as the making of knots or splices;

These methods have the drawback of causing an increase in the diameter of the region where the joinder has been effected; they also give rise to free ends; these two consequences are disadvantageous upon the subsequent use of these assemblages, for instance in automobile tires;

The second type consists of air entanglement techniques, currently referred to by the expression "air splicing"; these techniques give excellent results on multifilaments which are without twist; on the other hand, it is difficult to obtain a joinder of good quality on twists, since the threads of these twists are multifilaments which have been subjected to a twist.

The object of the invention is to overcome these drawbacks.

SUMMARY OF THE INVENTION

Accordingly, the present invention relates to a method of connecting the ends of two assemblages of threads, each of the assemblages being formed of at least two threads twisted together in the same direction, each thread being a multifilament and the assemblages having the same number of threads, the method being characterized by the following features:

(a) The ends of the assemblages are subjected to an untwisting operation in order to separate the threads of these ends from each other so as in this way to obtain free thread ends;

(b) As many junction pairs are formed as there are threads in each of the assemblages, each pair comprising a free end of one thread of each assemblage;

(c) The filaments are untwisted in at least a part of each of the threads, in the junction pairs;

(d) The untwisted parts are placed side by side in each junction pair so as to obtain a junction region, the junction regions being offset axially with respect to each other;

(e) The filaments of the two threads in each of these junction regions are assembled together by air splicing;

(f) All the threads which have thus been combined are assembled together by twisting in the direction of twist of the assemblages.

The present invention also concerns a device for connecting the ends of two assemblages of threads, the assemblages each consisting of at least two threads twisted together in the same direction, each thread being a multifilament and the assemblages having the same number of threads, the device having the following means:

(a) So-called separation means which make it possible to subject the ends of the assemblages to an untwisting operation so as to separate the threads of these ends from each other in order in this way to obtain free thread ends;

(b) So-called pairing means, making it possible to form as many junction pairs as there are threads in each of the assemblages, each pair having a free end of one thread of each assemblage;

(c) So-called untwisting means making it possible to untwist the filaments in at least a part of each of the threads in the junction pairs;

(d) So-called placement means, making it possible to place the untwisted parts side by side in each junction pair so as to obtain a junction region, these means being so arranged that the junction regions are offset axially from each other;

(e) Air splicing means making it possible to assemble the filaments of the two threads with each other in each of these junction regions;

(f) So-called assemblage means making it possible to assemble all the threads which have thus been combined, by twisting them together in the direction of the twist of the assemblages.

The invention also concerns the joint assemblages obtained by the method or with the device in accordance with the invention, as well as the articles, for instance automobile tires, reinforced with these assemblages.

DESCRIPTION OF DRAWINGS

The invention will be easily understood by means of the following examples and the schematic figures corresponding to these examples contained in the drawing, in which.

Each of FIGS. 3 to 8 shows one step in the method in accordance with the invention.

DESCRIPTION OF PREFERRED EMBODIMENTS

Figure 1:
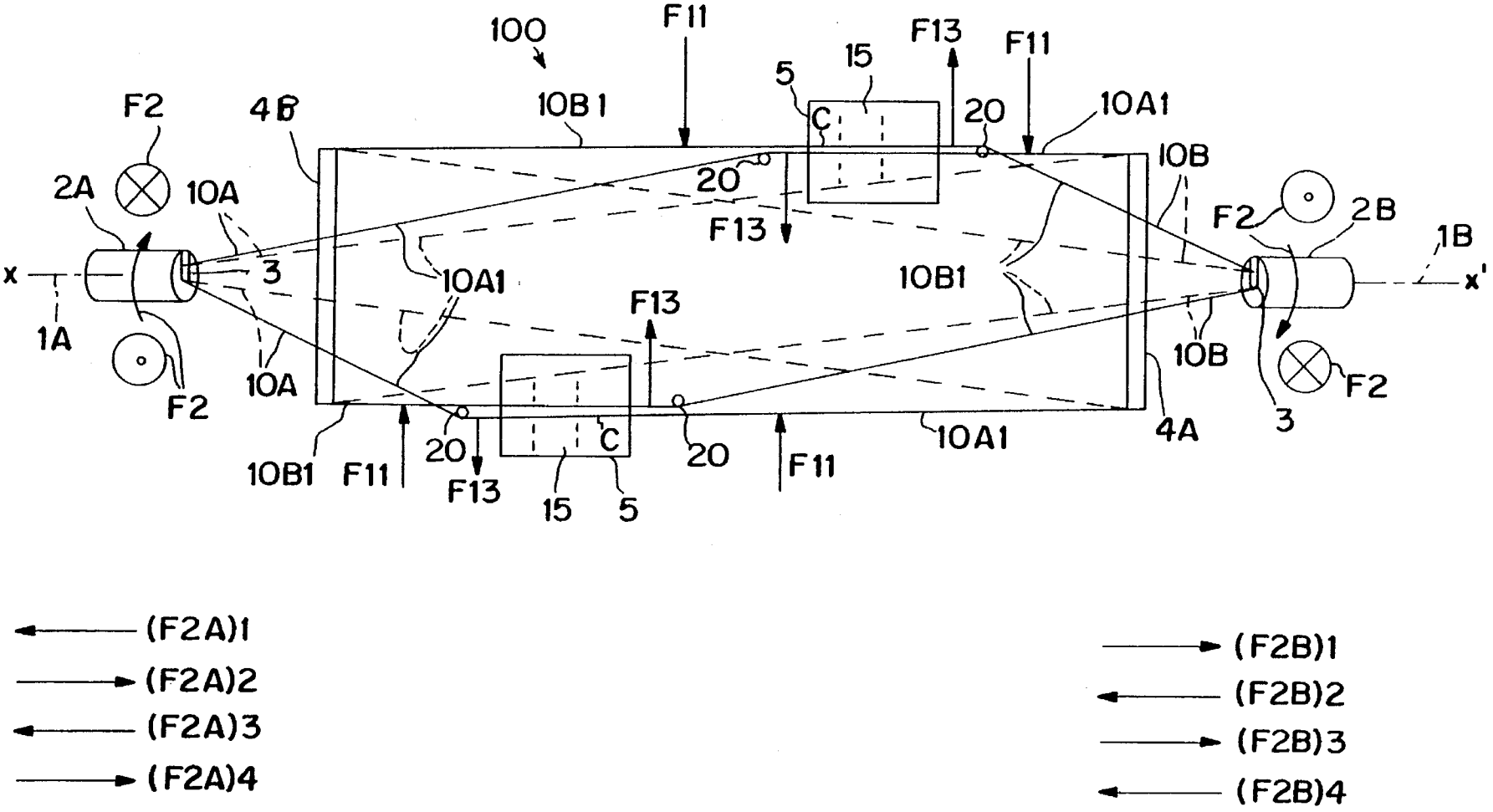
FIG. 1 shows a top view of a device in accordance with the invention.

FIG. 1 shows, in top view, a device 100 in accordance with the invention which makes it possible to carry out the method of the invention. This device 100 makes it possible to connect together by their ends two assemblages 1A, 1B which face each other, their axes being practically identical with the axis xx', for instance a horizontal axis. By way of example, each assemblage 1A, 1B is a twist comprising two threads 10A in the case of the twist 1A and two threads 10B in the case of the twist 1B, these threads 10A or 10B being twisted together in the same direction in the case of both twists, for instance the S direction, each thread 10A, 10B being a multifilament.

The device 100 comprises two rotating clamps 2A, 2B, each of which has a groove 3, and two spreaders 4A, 4B. These clamps and these spreaders are known per se and are not described here, for reasons of simplification.

The twist 1A is clamped in the groove 3 of the clamp 2A and the twist 1A is opened in order locally to separate the threads 10A from each other on the spreader 4A. The same is done with the twist 1B and its threads 10B, using the clamp 2B and the spreader 4B. The clamps 2A and 2B are then turned in the direction indicated by the arrows F2, thus causing the partial untwisting of the twists 1A and 1B, which produces the free parts 10A1 of threads 10A and the free parts 10B1 of threads 10B, these parts being shown in dashed line in FIG. 1.

The free parts 10A1, 10B1 thus act as free ends intended to be connected together.

The spreader 4B is arranged between the clamp 2A and the spreader 4A and, similarly, the spreader 4A is arranged between the clamp 2B and the spreader 4B, along the axis xx'.

Two apparatus 5 of the device 100 are then used to connect the free parts 10A1 and 10B1 together by a procedure which will be described in detail further below. These two apparatus 5 are identical; one of them is shown in profile in FIG. 2. The apparatus 5 comprises a housing 6 with a cover 7. The housing 6 comprises an upper plate 8 with a channel 9.

The apparatus 5 are brought into contact with the free parts 10A1, 10B1. These apparatus 5 are provided with guides 20 which guide the parts 10A1, 10B1 so that they are disposed within the channels 9 and are substantially parallel to the axis xx' in the apparatus 5. One thus obtains two pairs C of threads, each of these pairs being formed of a part 10A1 and a part 10B1, these parts being shown in solid line in FIG. 1, the threads 10A1, 10B1 of each of these pairs C being thus disposed in the channel 9 of an apparatus 5 the cover 7 of which is open, these threads being then substantially parallel to the axis xx'. The cover 7 is then closed. The apparatus 5 comprises two pairs of scissors 11 located at the ends of the channel 9. Each of these pairs of scissors 11 make it possible to cut a free part of an end 10A1, 10B1. These cuts are indicated by the arrows F11 in FIG. 1. Air is then fed under pressure into each of the two tubes 12, which are each located in the vicinity of a pair of scissors 11, each close to one end of the channel 9. The untwisting of the filaments of the thread 10A1, 10B1 which has been cut is thus brought about. This untwisting makes it possible to remove the twist of the filaments with each other which was produced in each part 10A1, 10B1 by the rotation of the clamps 2A, 2B. The cut and untwisted part of each thread 10A1, 10B1 is then caused to enter along the channel 9 towards the central part of said channel 9, due to the action of a spur 13 which can turn around its axis 14, moving the corresponding thread 10A1, 10B1 away from the other thread 10B1, 10A1, this spur being located at the opposite end of channel 9 with respect to the cut part, the displacement of which it causes. The action of the spurs 13 is diagrammatically indicated by the arrows F13 in FIG. 1. For purposes of simplification, the guides 20 have been shown only in FIG. 1.

Figure 2:
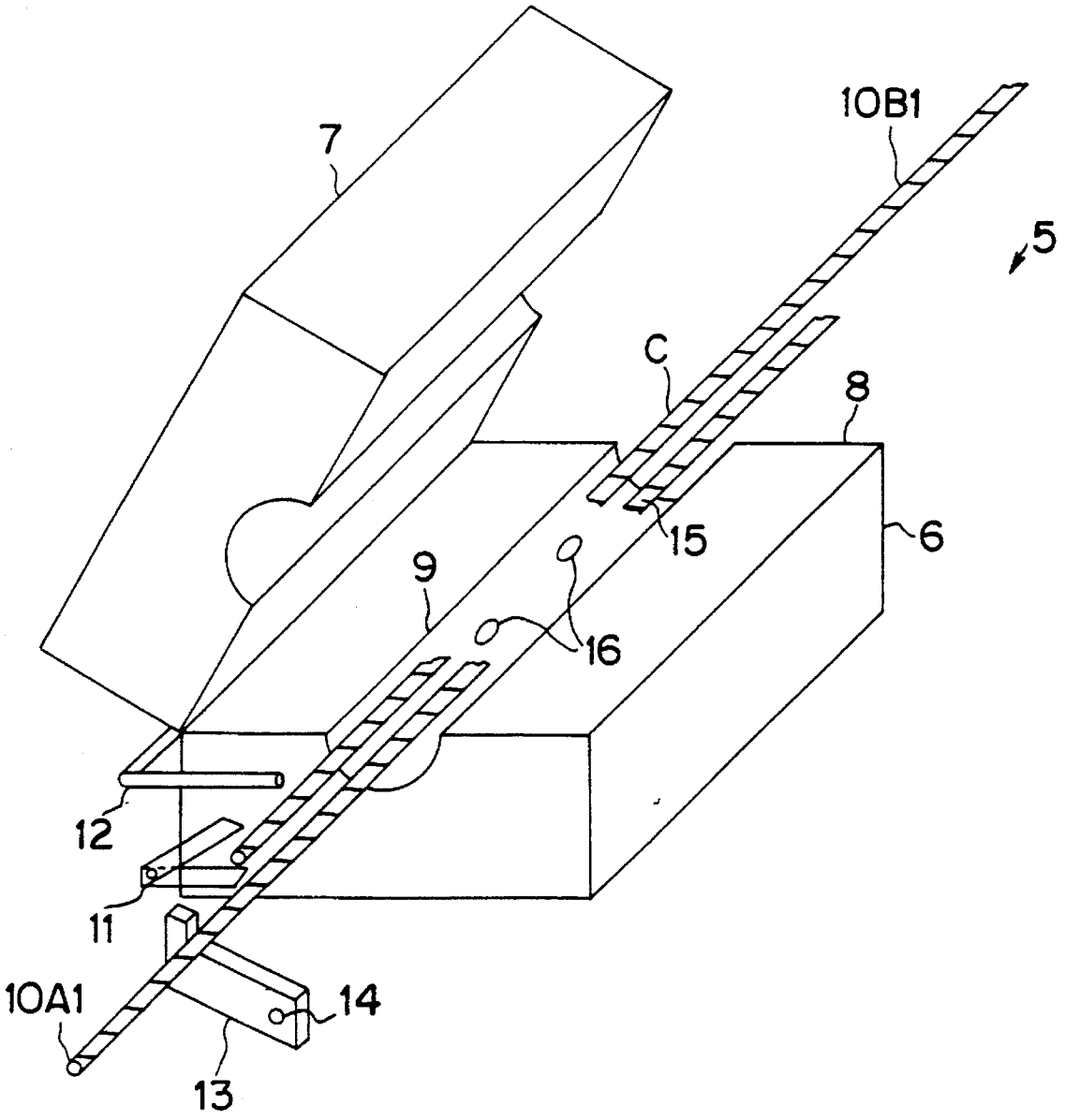
FIG. 2 is a profile view of an apparatus used in the device shown in FIG. 1.

These movements F13 are such that at the end of the movement of the spurs 13, there is present in each apparatus 5 an untwisted portion of a thread 10A1 disposed side by side with an untwisted portion of a thread 10B1 so as to form a junction region 15, indicated diagrammatically by two dashed lines in FIG. 1. In each apparatus 5 there is then produced the entanglement with each other by air of the filaments of the thread 10A1 and the filaments of the thread 10B1 in the junction regions 15. This splicing operation is obtained by causing air to pass into the openings 16 in the plate 8, the cover 7 being still closed. In FIG. 2, the threads 10A1, 10B1 have been assumed removed in the central region of the plate 8 so that the holes 16 are visible, and only one pair 11 of scissors, one tube 12 and one spur 13 have been shown, for purposes of simplification. The holes 16 are so arranged that they can, in known manner, cause, upon demand, either a non-turbulent movement of the air or a turbulent movement of the air during the splicing.

At the end of the splicing, the threads 10A1, 10B1 are then combined in each apparatus 5. These apparatus 5 are then removed, the cut ends of the threads 10A1, 10B1 are removed and the clamps 2A, 2B are turned in the direction opposite the arrows F2, so as to twist together the threads 10A1 and 10B1 which are connected together so as to obtain a final twist 17, this final twist causing the disappearance of the twists which appeared in the threads 10A1, 10B1 upon the rotation of the clamps 2A, 2B in the direction of the arrows F2.

Figure 8:
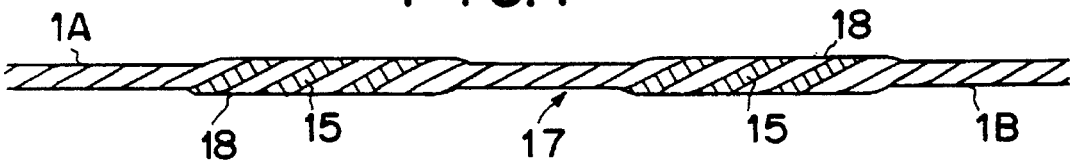

Such a final twist 17 is shown in FIG. 8, the joinder regions where the junction regions 15 are located being designated 18. In this twist 17, each thread 10A is thus connected to a thread 10B, as previously described.

Upon the operations described above, the apparatus 5 are shifted parallel to the axis xx' in such a manner that the junction regions 15 are offset axially along the axis xx', and therefore along the threads 10A1, 10B1. These regions 15 therefore do not overlap in the final twist. One thus obtains a final twist 17 which has only a very slight change in cross section at the joinder regions, with a large rupture strength in the joinder region, this strength representing at least 70% of that of each of the initial twists 1A, 1B.

The apparatus 5 can be brought towards or removed away from the threads 10A1, 10B1 by mechanical means capable, for instance, of imparting vertical movements to them. These means are known and, in the same way as the means for introducing air into the tubes 12 and the holes 16 are known, have not been shown in the drawing for purposes of simplification.

Upon the production of the final twist 17, the clamps 2A, 2B are subjected to the following four displacements:

First displacement—During the rotation of the clamps 2A, 2B in the direction indicated by the arrows F2 in order to cause the untwisting of the twists 1A, 1B, each of the clamps 2A, 2B is displaced with respect to the corresponding spreader 4A, 4B. These movements result as a whole in a movement of the clamps 2A, 2B apart from each other, these movements being diagrammatically indicated in FIG. 1 by the arrow (F2A) 1 in the case of the clamp 2A and by the arrow (F2B) 1 in the case of the clamp 2B.

Second displacement—Upon the formation of the pairs C by the action of the devices 5 with their guides 20, the clamps 2A, 2B approach each other, these movements being diagrammatically indicated in FIG. 1 by the arrow (F2A) 2 in the case of the clamp 2A and by the arrow (F2B) 2 in the case of the clamp 2B.

Third displacement—When the threads 10A1, 10B1 are attached together, before the final twisting, the apparatus 5, with their guides 20, are removed and the clamps 2A, 2B again move apart from each other in order to resume substantially the position which they had just after the untwisting. These movements are diagrammatically indicated in FIG. 1 by the arrow (F2A) 3 in the case of the clamp 2A and by the arrow (F2B) 3 in the case of the clamp 2B.

Fourth displacement—Upon the final twisting of the attached threads 10A1, 10B1 in order to obtain the twist 17, the clamps 2A, 2B, which then turn in direction opposite the arrows F2, approach each other. These movements are diagrammatically indicated in FIG. 1 by the arrow (F2A) 4 in the case of the clamp 2A and by the arrow (F2B)4 in the case of the clamp 2B.

All of these displacements of the clamps 2A, 2B which have been described above are carried out, for example, substantially along the axis xx', each of the clamps 2A, 2B being mounted on an articulated support which pivots, for instance, around an axis substantially perpendicular to a vertical plane passing through the axis xx'. On the other hand, the spacers 4A, 4B are stationary.

All these displacements are obtained with means which make it possible to obtain identical tension for the threads 10A1, 10B1; these means are known to the person skilled in the art and they comprise, for instance, springs and/or cams, these means not having been shown in the drawing for purposes of simplification.

The various steps of the method are indicated diagrammatically in FIGS. 3 to 8.

Figure 3:
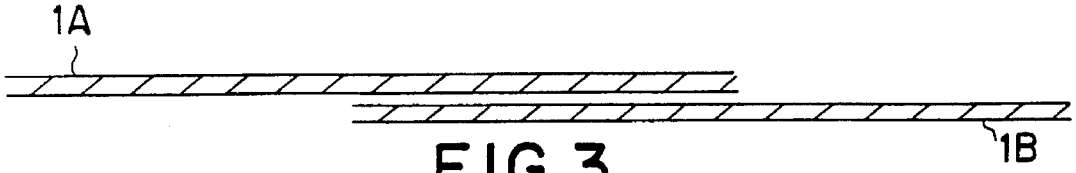

FIG. 3 shows the twists 1A, 1B which are to be joined.

Figure 4:
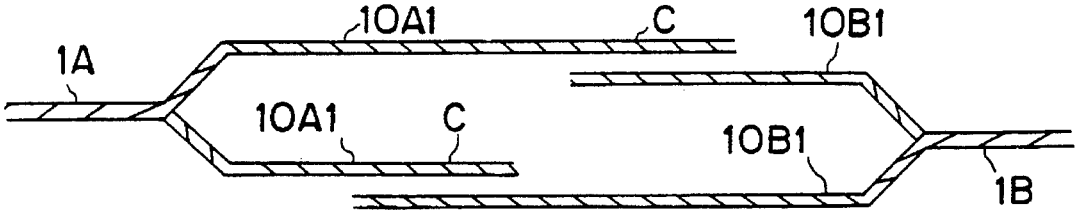

FIG. 4 shows the two pairs C of threads 10A1, 10B1 before the untwisting operation has been effected.

Figure 5:
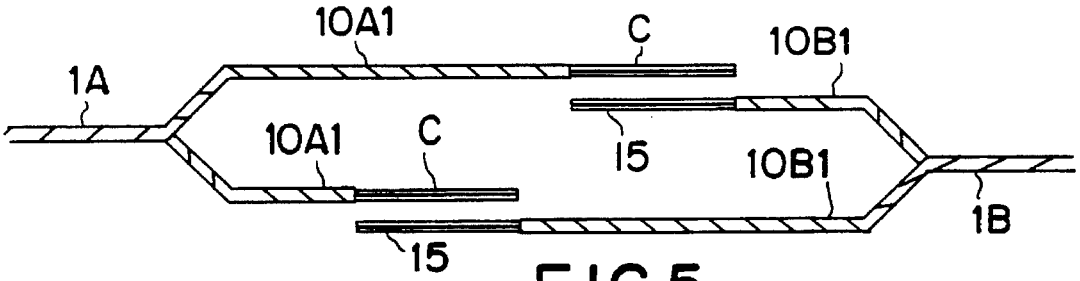

FIG. 5 shows the two pairs C of threads 10A1, 10B1 with, for each pair C, the junction region 15 formed by the untwisted part of these threads.

Figure 6:
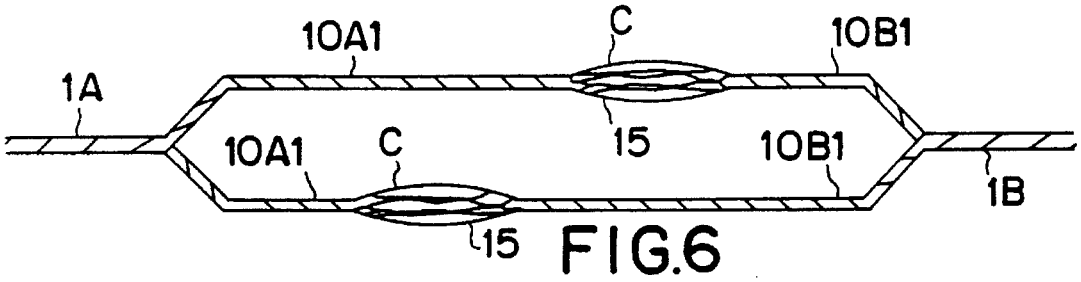

FIG. 6 shows the two pairs C of threads 10A1, 10B1 after splicing of the regions 15 in order to combine these threads together, the filaments of these threads being entangled without turbulent movement of the air.

Figure 7:
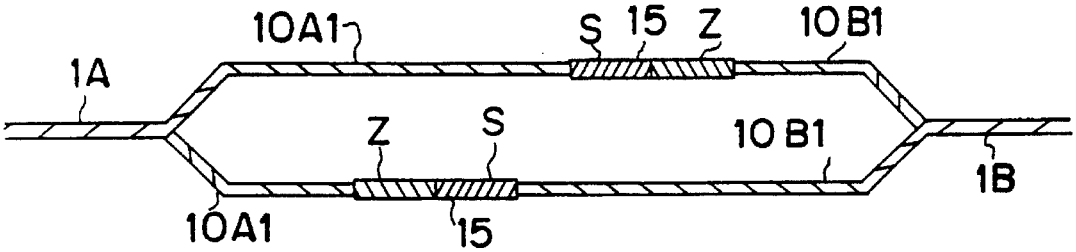

FIG. 7 shows another variant of the step shown in FIG. 6 in which the splicing is effected with turbulent movements of the air so as to have, for each region 15, a helical structure with one S winding and one Z winding.

FIG. 8 shows the final twist 17.

EMBODIMENT

The device 100 is used to join the ends of two identical twists of rayon, each twist having the following characteristics:

Number of threads: 2; each thread has a linear density of 184 tex and a twist of 360 turns/meter;

Rupture strength: 180N.

After joinder, the rupture strength in the joinder region is 130N (namely 72% of the initial strength, the decrease of this strength therefore being only 28%), and the increase in cross section in the region of joinder is 50%, as compared with the initial section of each twist.

By way of comparison, the conventional joinder techniques cause practically a doubling of the cross section and a decrease in the rupture strength of about 60% in the joinder region.

The invention is not limited to the embodiments which have been described above. Thus, for instance, the invention applies to cases in which the joining of assemblages other than twists and/or comprising more than two threads is effected.

We claim:

1. A method of connecting the ends of two assemblages of threads, each of the assemblages being formed by at least two threads twisted together in the same direction, each thread being a multifilament thread, the assemblages having the same number of threads, the method comprising:

(a) untwisting the ends of the assemblages in order to separate the threads of these ends from each other so as, in this way, to obtain free ends of threads;

(b) forming as many junction pairs as there are threads in each of the assemblages, each pair comprising a free end of one thread of each assemblage;

(c) untwisting the filaments being in at least a part of each of the threads, in junction pairs, by untwisting means which employ air;

(d) placing the untwisted parts side by side in each junction pair as so to obtain a junction region, the junction regions being shifted axially from each other;

(e) assembling the filaments of the two threads together by air splicing in each of these junction regions;

(f) assembling together all of the threads thus combined by twisting in the direction of twist of the assemblages; and (g) performing the untwisting step (a) above to separate the threads of the ends of the assemblages and the assembling step (f) above by using spaced apart rotating means which act separately and in the same manner on an intermediate part of each of the assemblages in such a manner that, for each assemblage, the untwisting and the twisting operations occur with rotations in opposite directions, the spaced apart rotating means moving apart from each other during the untwisting step (a) and approaching each other during the twisting of the assembling step (f).

2. A method according to claim 1 in which at least two threads from one assemblage are assembled to at least two threads from another assemblage.

3. A device for connecting the ends of two assemblages of threads, each of the assemblages being formed of at least two threads twisted together in the same direction, each thread being a multifilament thread and the assemblages having the same number of threads, the device comprising:

(a) separating means for untwisting the ends of the assemblages in order to separate the threads of these ends from each other so as thus to obtain free ends of threads;

(b) pairing means to constitute as many junction pairs as there are threads in each of the assemblages, each pair including a free end of a thread of each assemblage;

(c) untwisting means employing air to untwist the filaments in at least a part of each of the threads in the junction pairs;

(d) placement means for placing the untwisted parts side by side in each junction pair as to obtain a junction region, said means shifting the junction regions axially relative to each other;

(e) air-splicing means to assemble together the filaments of the two threads in each of these junction regions;

(f) assembling means assembling together by twisting all the threads which have thus been combined in the direction of twist of the assemblages; and (g) the separating means (a) above for subjecting the ends of the assemblages to an untwisting operation in order to separate the threads and the assembling means (f) above for assembling together all the threads by a twisting operation including spaced apart rotating means which act separately and in the same manner on an intermediate part of each of the assemblages in such manner that, for each said assemblage, the untwisting and the twisting operations occur with rotations in opposites directions, the spaced apart rotating means moving apart from each other during the untwisting operation and approaching each other during the twisting operation.

4. A device according to claim 3 in which at least one of the rotating means comprise a turning clamp for each assemblage.

5. A device according to claim 3 in which the separating means comprise two spreaders, one for each assemblage.

6. A device according to claim 3 in which the pairing means comprise two channels, one for each pair.

7. A device according to claim 6 in which the untwisting means for each junction pair are arranged at the ends of the channel.

8. A device according to claim 6 including means to cut the free ends of the threads before untwisting, these means being arranged for each junction at the ends of the channel.

9. A device according to claim 6 in which the placement means for each junction pair are arranged at the ends of the channel.

10. A device according to claim 3 in which the pairing means, the untwisting means, the placement means and the air-splicing means form a unit for each junction pair, the device comprising means to displace said unit in order to place it in contact with the threads of the pair, or in order to remove it from said threads.

11. A device according to claim 3 in which the the rotating means comprise two turning clamps, one for each assemblage, each capable of being driven in rotation in one direction for the separation of the threads and in the opposite direction for the assemblage twisting of the threads.

12. A device according to claim 11 in which the assemblages face each other, and the pairing means (b), the untwisting means (c), the placement means (d) and the air-splicing means (e) are located between the turning clamps.

13. A device according to claim 11 in which each turning clamp is mounted on an articulated support which pivots around an axis.

14. A device according to claim 13 in which the assemblages are arranged substantially on the same axis and the axis around which each articulated support pivots is substantially perpendicular to a plane passing through the axis of the assemblages.

15. A device according to claim 3 in which the assemblages are arranged substantially on the same axis.

16. A device as set forth in claim 3 including means for obtaining identical tension for the threads.

* * * * *

UNITED STATES PATENT AND TRADEMARK OFFICE

CERTIFICATE OF CORRECTION

PATENT NO. : 5,479,769

DATED : Jan. 2, 1996

INVENTOR(S) : Belloy et al.

It is certified that error appears in the above-indentified patent and that said Letters Patent is hereby corrected as shown below:

Col. 6, line 8, "being in" should read --in--;

line 50, "as" should read --so as--.

Col. 7, line 1, "opposites" should read --opposite--.

Signed and Sealed this

Twenty-fifth Day of June, 1996

Bruce Lehman

*Attest:*

BRUCE LEHMAN

*Attesting Officer*

*Commissioner of Patents and Trademarks*